US006726601B1

(12) United States Patent
Beutel

(10) Patent No.: US 6,726,601 B1
(45) Date of Patent: Apr. 27, 2004

(54) PHYSICAL TRAINING APPARATUS AND TRACTION DEVICE THEREFOR

(75) Inventor: Günther Beutel, Oberstenfeld (DE)

(73) Assignees: Koopera GmbH, Oberstenfeld-Gronau (DE); Germania Geräte Bau-und Vertriebs-GmbH, Landau (DE)

( * ) Notice: Subject to any disclaimer, the term of this patent is extended or adjusted under 35 U.S.C. 154(b) by 0 days.

(21) Appl. No.: 09/308,600

(22) PCT Filed: Nov. 22, 1997

(86) PCT No.: PCT/DE97/02747

§ 371 (c)(1),
(2), (4) Date: May 19, 1999

(87) PCT Pub. No.: WO98/23334

PCT Pub. Date: Jun. 4, 1998

(30) Foreign Application Priority Data

Nov. 22, 1996 (DE) ..... 296 20 247 U
Apr. 29, 1997 (DE) ..... 297 07 943 U

(51) Int. Cl.[7] ..... A63B 22/04
(52) U.S. Cl. ..... 482/52; 482/120; 482/121
(58) Field of Search ..... 482/102, 103, 482/114, 115, 116, 120, 121, 122, 126, 129, 140, 142, 143, 144, 148, 907, 908, 52, 23, 130

(56) References Cited

U.S. PATENT DOCUMENTS 2,977,120 A 3/1961 Morris
3,640,528 A * 2/1972 Proctor ..... 482/102

(List continued on next page.)

FOREIGN PATENT DOCUMENTS

DE 7908930 9/1979
DE 3313299 10/1984
DE 4003538 8/1990
DE 4213442 10/1993

OTHER PUBLICATIONS

"Bodylife"—Fachzeitschrift für die Fitnessbranche; Nov./Dec. 1993, Nr. 26.
"Pro For Fit"—Products for Fitnessmanagement; Mar. 1996.

*Primary Examiner*—Nicholas D. Lucchesi
*Assistant Examiner*—Tam Nguyen
(74) *Attorney, Agent, or Firm*—Horst M. Kasper

(57) ABSTRACT

A training machine (100) for the physical training of persons, having, arranged on it, traction devices (102) with pull cords and deflecting rollers, is characterized by a central carrying device (106) displaceably mounted as a unit, traction-device holding rods (108) articulated in the upper region of the carrying device (106), which are present circumferentially around the carrying device (106), at least in regions, in a predeterminable pattern, which are designed to be capable of being unfolded and folded up, as required, and which, in the unfolded state, delimit the respective training area available to a person for training purposes, floor supporting profiles (110) articulated in the lower region on the carrying device (106), which are present circumferentially around the carrying device (106) in a predeterminable pattern, which are designed to be capable of being unfolded and folded up, as required, and which, in the unfolded state, are supported on a standing floor and ensure the stability of the training machine (100), the traction devices (102) being arranged on the traction-device holding rods (108) and/or the floor supporting profiles (110) and/or the carrying device (106).

31 Claims, 15 Drawing Sheets

U.S. PATENT DOCUMENTS 4,402,504 A 9/1983 Christian
4,431,181 A * 2/1984 Baswell ..... 272/62
4,549,733 A 10/1985 Salyer
4,603,855 A 8/1986 Sebelle
5,527,245 A * 6/1996 Dalebout et al. ..... 482/54
5,626,541 A * 5/1997 Ramlogan et al. ..... 482/72
5,906,566 A * 5/1999 Whitcomb ..... 482/130

* cited by examiner

PHYSICAL TRAINING APPARATUS AND TRACTION DEVICE THEREFOR

TECHNICAL FIELD

The present invention relates to a training machine for the physical training of persons, having, arranged on it, traction devices with a pull cord and deflecting rollers.

PRIOR ART

Known training machines are distinguished in that they are of stationary design and require a certain amount of space. Small machines are also known, which are designed to be transportable, but the training versatility and use of which are markedly restricted. Training machines which can be folded together and cleared away are also known, the number of exercising persons and training versatility being sharply restricted with these machines.

In order to implement various training methods in the aerobic area of a fitness studio, so-called "steppers" 1 are used, which are illustrated diagrammatically in FIG. 2 in a group of exercising persons 5. The steppers 1 possess two laterally arranged rubber pull grips 2, 3 which are grasped manually by the exercising persons 5 and can be pulled out. These rubber pull grips 2, 3 ensure that specific muscle groups are exercised, but do not cover the entire range of muscles to be exercised, since they can be pulled out only from below or laterally.

In this training method, in particular, group-dynamic training—a trainer demonstrates the exercises and the other persons imitate him, must be judged as very positive. Joint training motivates those who are exercising.

Moreover, traction devices with pull cords and deflecting rollers are known, in which the pull cord is guided in such a way as to provide oblique pull-cord feed angles along the path to the deflecting rollers, so that it is no longer possible to operate the traction device over a large pivotable angular range or a permanently operative feed of the pull cord to the deflecting rollers can no longer be ensured, since the feed of the pull cord at oblique angles results in increased stresses on the pull cord or the deflecting rollers, thus leading to relatively rapid wear of the pull cord and not being very conducive to long-lasting usefulness.

PRESENTATION OF THE INVENTION

The object or technical problem on which the present invention is based is to specify a training machine which allows several persons to train, the exercising of all muscle parts and group-dynamic training, taking into account, in particular, the fact that the possibility of space-saving storage when the machine is not required is afforded, so that the space freed in this way, in particular in the sports studio area or rehabilitation area, can be utilized for other purposes. The object on which the invention is based is, furthermore, to provide a training machine which, whilst ensuring optimum training possibilities, makes it possible to have a simple design and therefore economical production.

The object on which the invention is based is, moreover, proceeding from the prior art mentioned, to make available a traction device for a training machine of the type mentioned in the introduction, which ensures an optimum wear-free feed of the pull cord, can be used variably within a training machine and ensures that the pulling force of the pull cord to be actuated can easily be adjusted.

The training machine according to the invention is provided by the features of the independent claim 1. The traction device according to the invention for a training machine of this kind is provided by the features of the independent claim 13.

The training machine according to the invention is characterized by the interaction of the following features:

- a central carrying device displaceably mounted as a unit,
- traction-device holding rods articulated in the upper region of the carrying device,
- which are present circumferentially around the carrying device, at least in regions, in a predeterminable pattern,
- which are designed to be capable of being unfolded and folded up, as required, and
- which, in the unfolded state, delimit the respective training area available to a person for training purposes,
- floor supporting profiles articulated in the lower region on the carrying device,
- which are present circumferentially around the carrying device in a predeterminable pattern,
- which are designed to be capable of being unfolded and folded up, as required, and
- which, in the unfolded state, are supported on a standing floor and ensure the stability of the training machine,
- the traction devices being arranged on the traction-device holding rods and/or the floor supporting profiles and/or the carrying device.

The training machine according to the invention ensures that a fold-up multifunctional training machine for three-dimensional traction is implemented. By virtue of the foldability of the traction-device holding rods and floor supporting profiles, in conjunction with the carrying device displaceably mounted as a unit, the training machine can be optimally employed for the intended purposes of use. On the one hand, space-saving storage is ensured and, on the other hand, it is ensured, in the set-up state, that, in particular, several persons training can train on the training machine, exercising of all muscle parts being possible both in the individual and in the group-dynamic area.

A particularly preferred embodiment ensuring an optimum structural design is distinguished in that the traction-device holding rods and the floor supporting profiles are arranged around the carrying device in a radial pattern, the carrying device itself having a radial contour circumferentially.

A particularly preferred embodiment of the training machine according to the invention is distinguished in that the unfolded floor supporting profiles, as seen in a top view of the training machine, are arranged in each case essentially centrally between two unfolded traction-device holding rods in the unfolded state. It proved beneficial, at the same time, according to a particularly advantageous development, to design the training machine in such a way that a seat is arranged on each of the floor supporting profiles, the exercising person having the possibility of exercising all the muscle parts by means of the traction devices present on the training machine.

A preferred embodiment is based on the principle that the carrying device is designed, in terms of its circumferential structure, as a circular profile unit which is characterized in that the circumferential angle between two adjacent traction-device holding rods is 180° or 120° or 90° or 60° or has an even smaller devisor of 360°.

An embodiment which is particularly preferred with a view to economical production, whilst ensuring permanently reliable functioning, is distinguished in that the carrying device has essentially vertically arranged profile bars which are connected on the top side to a head unit, in particular a head plate, and on the bottom side to a base unit, and between the head unit and base unit there is at least one guide unit which is guided longitudinally displaceably in or on the profile bars, the guide unit is connected directly or indirectly to the traction-device holding rods and/or the floor supporting profiles, and the folding movement of the traction-device holding rods and of the floor supporting profiles is determined by the displacement of the guide unit.

As regards a solution which is particularly simple in terms of design and is permanently reliable, it must be considered particularly advantageous, according to the invention, that there are stroke profile bars which are articulated rotatably on the guide unit via a lower rotary joint and on the traction-device holding rods via an upper rotary joint, and that the traction-device holding rods are in each case articulated on the head unit via a rotary joint.

In conjunction with the abovementioned features regarding advantageous economical production and permanently reliable functioning, a further embodiment of the training machine according to the invention is distinguished in that the floor supporting profiles are articulated on the carrying device/profile bars via a longitudinally displaceable rotary joint, on which the guide unit acts, and in each case there is a rotary profile bar which is in each case connected in an articulated manner, via rotary joints, between the floor supporting profile and the base unit or the carrying device.

The guide unit may either be designed, in terms of its displacement travel, by means of a manually actuable unit, in particular a spindle stroke rod with a rotary grip, or else, according to the invention, an electrically or hydraulically or pneumatically operated drive unit may also be used, which, via a corresponding control device, controls the displacement travel of the guide unit and consequently the folding action of the traction-device holding rods and floor supporting profiles.

A particularly preferred development of the training machine according to the invention is distinguished in that the operation of folding together the traction-device holding rods and the floor supporting profiles is designed in such a way that the floor supporting profiles are folded away or folded up with a time lag only after the traction-device holding rods are already at least partially folded up.

An embodiment of the training machine according to the invention which is particularly advantageous in terms of economical production, whilst ensuring permanently reliable functioning, is distinguished in that the carrying device and/or the traction-device holding rods and/or the floor supporting profiles and/or the stroke profile bars are designed as metallic profile units which have at least one mortise, in particular essentially T-shaped, which is continuous in the profile longitudinal direction, in such a way that structural elements to be connected can be connected via correspondingly shaped tenon blocks.

A traction device, making optimum training facilities available, for a training machine for the physical training of persons, in particular for the above-described training machine, with a pull cord and with a first deflecting device for the pull cord, having a roller block articulated rotatably about an axis of rotation in a bearing body and having a first deflecting roller and a second deflecting roller which are mounted in a rolling plane and rotatably on the roller block and between which the pull cord can be pulled out by the exercising person, is distinguished, according to the object presented or the problem presented, in that a rotary bearing unit is present concentrically to the axis of rotation on the top side and the bottom side of the roller block in each case, at least one rotary bearing unit is designed as a bearing bush with a continuous recess, the pull cord of the first and second deflecting rollers is fed through this recess, that is to say in the axis of rotation of the roller block, and the axis of rotation of the deflecting rollers is in each case arranged at that vertical distance from the axis of rotation of the roller block which corresponds to the dimension of the respective rolling radius of the said deflecting rollers.

A preferred embodiment of the traction device according to the invention is distinguished in that the pull cord is fed through the bearing bush of the rotary bearing unit of the bearing body via at least one further fourth deflecting roller which is arranged independently of the first deflecting unit and the rolling plane of which runs through the axis of rotation of the roller block and the axis of rotation of which is arranged at that distance from the axis of rotation of the roller block which corresponds to the rolling radius of the said deflecting roller.

It proved beneficial to design the traction device in such a way that it is characterized in that, in addition to the first and second deflecting rollers, there is, on the first deflecting unit, a third deflecting roller, the axis of rotation of which is arranged perpendicularly to the axis of rotation of the roller block, the axis of rotation of the roller block and the rolling plane of the third deflecting roller being arranged opposite and offset with respect to one another outside the mid-plane of the deflecting unit.

In terms of the variability of use of the traction device, whilst permanently reliable and simple functioning is ensured at the same time, it proved particularly beneficial to design the device in such a way that the first deflecting unit has integrally formed on it a second deflecting unit, of which the structural elements, such as the bearing body, roller block and deflecting rollers, are arranged axially symmetrically to the longitudinal axis, as seen in a view of the rolling plane of the third deflecting roller, and are arranged point-symmetrically to the first deflecting unit, as seen in a cross section.

Economical production and a solution individually adaptable to the respective training methods are distinguished in that the device is designed to be capable of being fastened by means of tenon blocks to profile elements of a training machine which have mortises.

Other embodiments and advantages of the invention are afforded by the features also listed in the claims and by the exemplary embodiments given below. The features of the claims may be combined with one another in any way desired, insofar as they are not obviously mutually exclusive.

BRIEF DESCRIPTION OF THE DRAWING

The invention and advantageous embodiments and developments thereof are described and explained in more detail below with reference to the examples illustrated in the drawing. The features to be gathered from the description and the drawing may, according to the invention, be applied individually in themselves or severally in any desired combination. In the drawing.

EXEMPLARY EMBODIMENTS OF THE INVENTION

Figure 1:
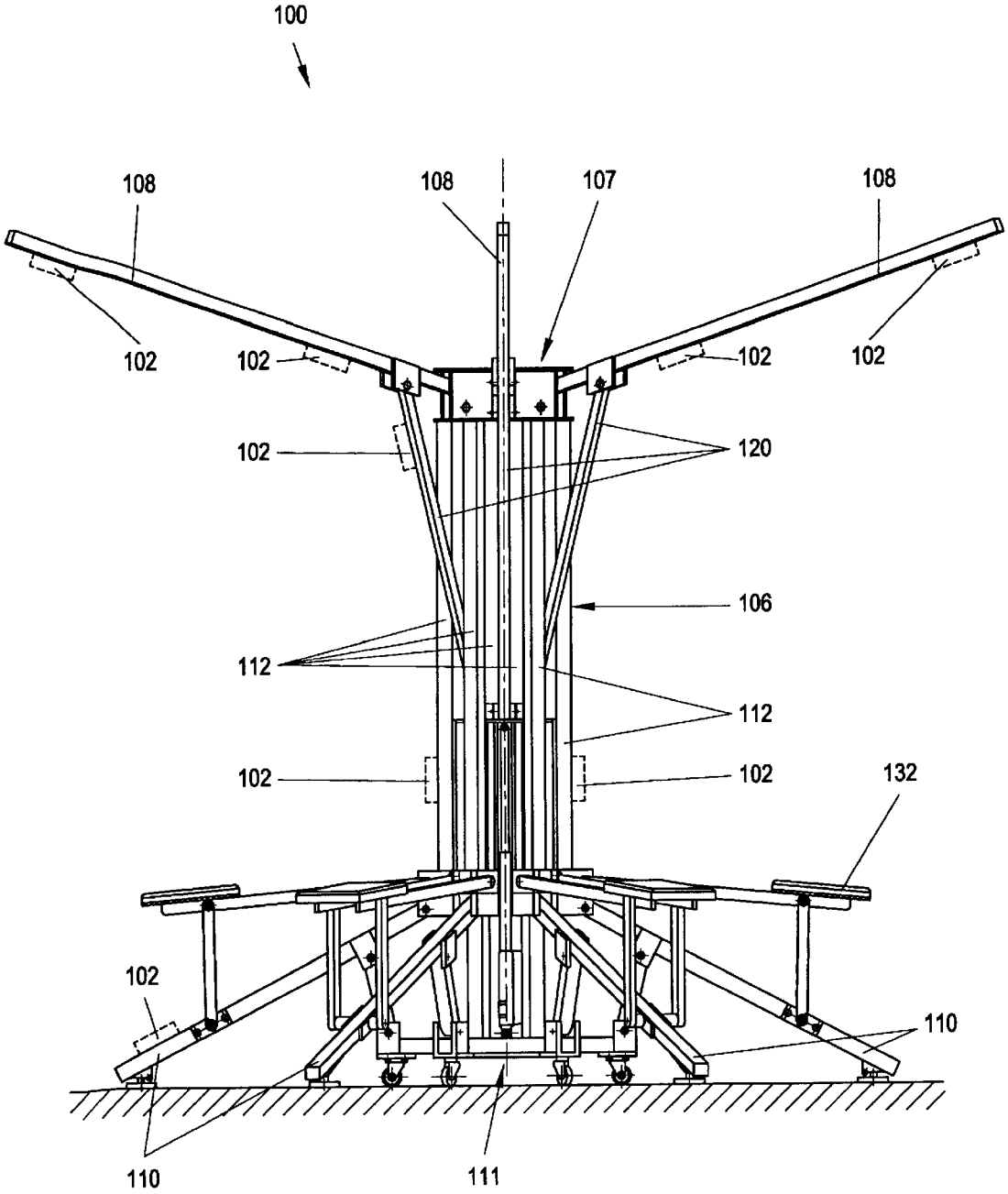
FIG. 1 shows an exemplary embodiment of the training machine with a carrying device composed of vertically arranged profile bars, unfolded traction-device holding rods and unfolded floor supporting profiles with seats.
Figure 2:
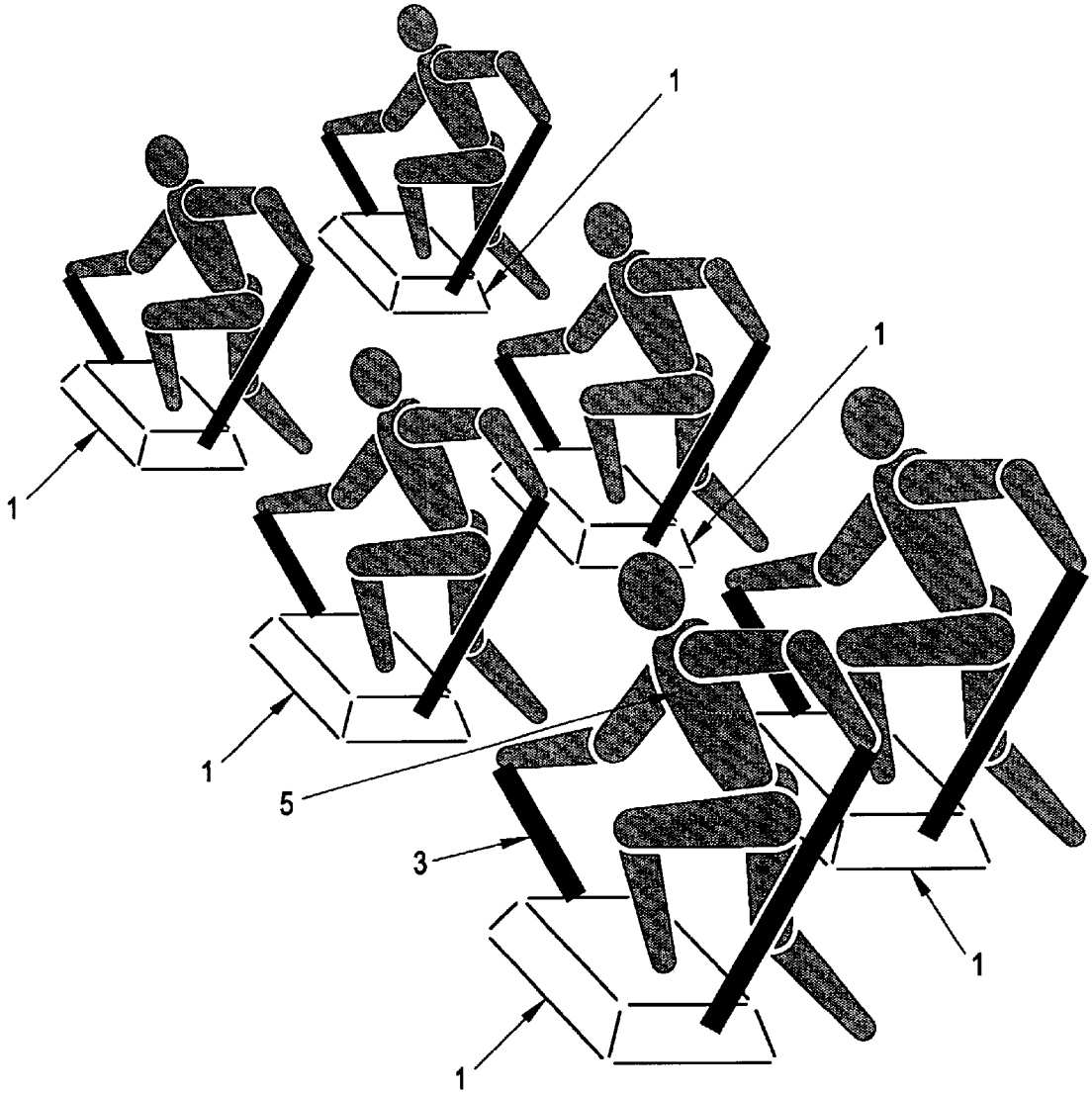
FIG. 2 shows a diagrammatic illustration of the training of persons on known so-called "steppers" for the aerobic area.
Figure 3:
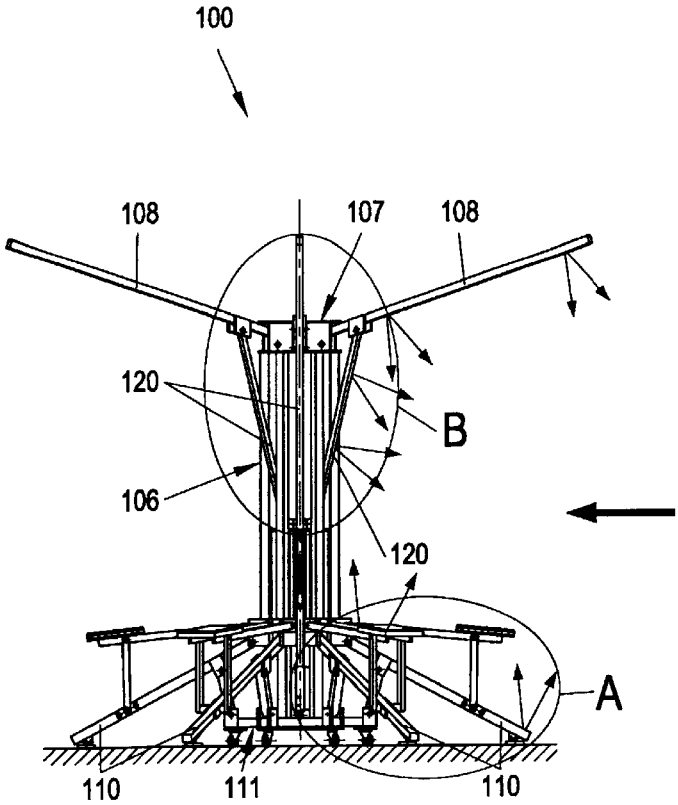
FIG. 3 shows a diagrammatic perspective illustration of the training machine according to FIG. 1, with traction devices which are illustrated diagrammatically by arrows.
Figure 4:
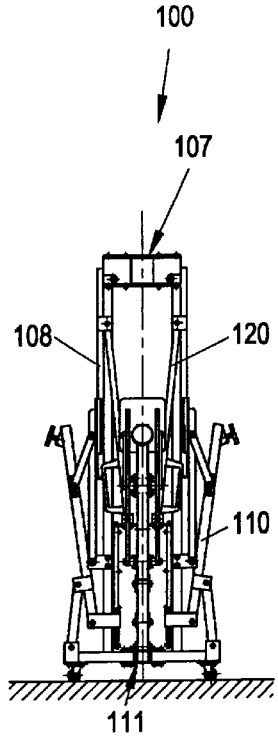
FIG. 4 shows a diagrammatic perspective illustration of the training machine according to FIG. 3 in the folded-together state.

A training machine 100 possesses a carrying device 106, which consists of vertically arranged profile bars 112 with mortises 125 which are continuous in the longitudinal direction, altogether six profile bars 112 being arranged so as to be offset, each at a circumferential angle of 60°, along the contour of a circle, as seen in a top view. The lower end of the profile bars 112 is connected to a base unit 111 which is mounted on rollers 117. The upper end of the profile bars 112 is connected to a head unit 107. Fastened below the head unit 107 is an accumulator 115 which supplies current to a linear drive 130 arranged on the base unit 111 and having an extensible push rod 131. The push rod 131 is illustrated in the extended state in FIG. 10. Connected to the end of the push rod 131 is a guide unit 118 which is designed as a guide plate within the carrying device 106. At the edge of the guide unit 118 there are guide bars 119 which point downwards, offset at a circumferential angle of 60°, and which are connected to a plastic guide profile 121, this guide profile 121 possessing an integrally formed cross-sectional portion 123 which is in the form of a tenon block and which engages into the corresponding mortise 125 of the respective perpendicular profile bar 112, thereby ensuring permanently reliable, stable and accurate longitudinal guidance of the guide unit 118 when the linear drive 130 is actuated.

The lower end of the guide bar 119 is connected to a linear guide 127 which is longitudinally displaceable on the respective profile bar 112 and to which an outwardly foldable floor supporting profile 110 is rotatably connected via a rotary joint 126.

Furthermore, a rotary profile bar 128 is articulated on the floor supporting profile 110 via a rotary joint 136, the said rotary profile bar being articulated, in turn, at its other end, on a holding profile 129 of the base unit 111 above the roller 117 via a rotary joint 138.

A footplate 136, on which the floor supporting profile 110 is supported in the unfolded state, is present on the free end region of the floor supporting plate 110, the said end region being located opposite the linearly guided rotary joint 126. An elastic spring element or rubber buffer, not illustrated in any more detail in the figures, may be arranged between the footplate 136 and floor supporting profile 110.

Arranged above the floor supporting profile 110 is a seat 132 which is likewise foldable via a triple-joint structure, having the joint bars 138 and 139, via rotary joints 166, 167. In this case, the rotary joint 166 is located fixedly above the rotary joint 126 on a profile bar 112 and the rotary joint 167 is located fixedly on the floor supporting profile 110. The two bars 138, 139 are, in turn, connected rotatably to one another via a common rotary joint 168 which is located below the seat 132.

A foldable traction-device holding rod 108 is connected in the head unit 107 via a rotary joint 134. The rotary joint 134 sits on a short projecting unit 133 arranged at right angles to the longitudinal direction of the traction-device holding rod 108. A guide plate 158 is present in the region of the rotary joint 134 on the left and right of the traction-device holding rods 108 in each case, the said guide plate serving for the lateral stabilization of the traction-device holding rods during the folding operation. A further head plate 114 is fastened to the top side of these guide plates 158.

A stroke profile bar 120 is connected rotatably to the top side of the guide unit 118 via a lower rotary joint 122, the said stroke profile bar being, in turn, rotatably connected with its other end region to the traction-device holding rod 108 via an upper rotary joint 124. The upper rotary joint 124 is in relative proximity to the rotary joint 134.

A holding grip 135 is arranged in the lower region of the stroke profile bar 120. Finally, there is also a hand-operated part 137 which is connected, for example via the connecting cable 141, to the electronics for activating the linear drive, the electronics being arranged in the housing of the accumulator 115. The cable 141 has a length making it possible to step out of the danger zone of the moved parts during the folding operation. The linear drive 130 is controlled by means of this hand-operated part 137.

Traction devices, which are described in more detail below, are illustrated diagrammatically in FIG. 10 in the form of rectangles on the bottom side of the traction-device holding rods 108, on the stroke profile bar 120 and on the top side of the floor supporting profile 110.

Figure 23:
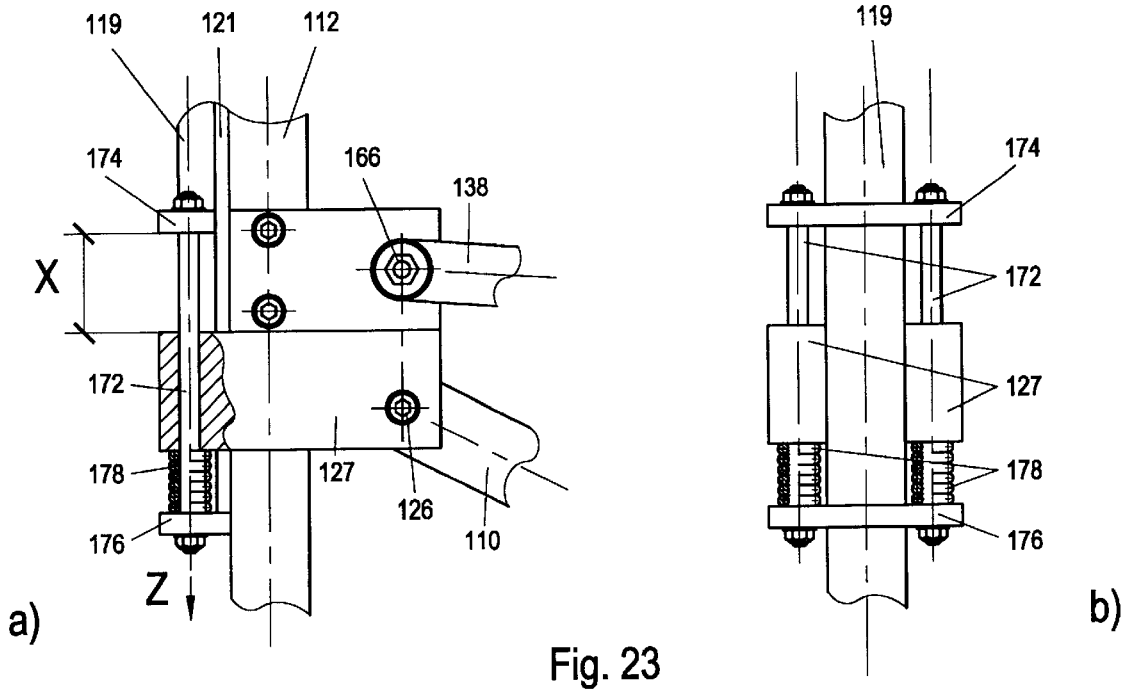
Figure 24:
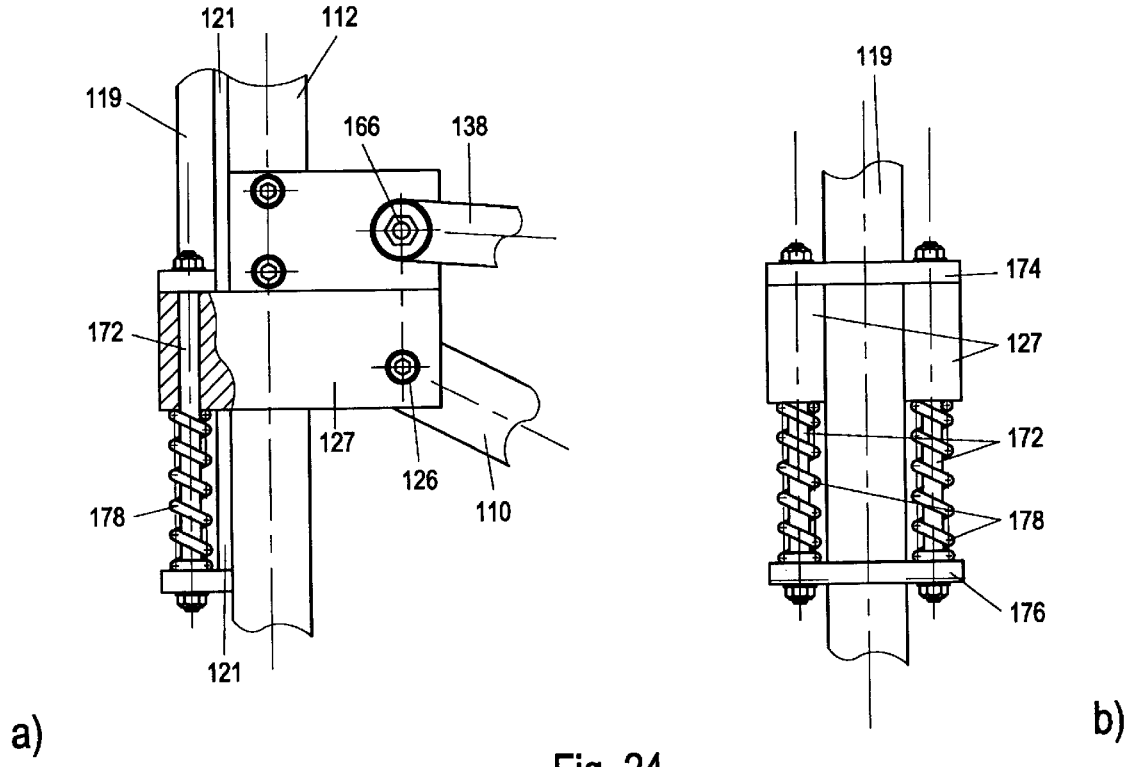

A detail of the connection of the guide bars 119 to the respective linear guides 127 of the rotary joints 126 is illustrated in FIGS. 23 and 24. The guide profile 119 possesses, in its region of connection to the linear guide 127, bar elements 172 which are guided in each case through the linear guides 127 present on both sides and which are coupled to one another via an upper stop element 174 and a lower stop element 176. A helical compression spring 178 is in each case arranged, around the bar element 172, between the lower stop element 176 and the lower edge of the linear guide 127. The unfolded state of the floor supporting profiles 110 is illustrated in the FIGS. 23*a* and *b*. For folding together, the guide bar 119, together with its bar elements 172 is displaced downwards in the direction of the arrow Z according to FIG. 23*a*. At the same time, the guide bar 119 executes an idle travel "X", within which the linear guide 127 is not taken up and co-displaced by the upper stop element 174. As long as the guide bar 119 executes the idle travel "X", however, the traction-device holding rod 108 is already being folded up as a result of the coupling of the traction-device holding rod to the guide unit 118 via the stroke profile bar 120. As soon as the guide bar 119 has executed the travel "X", the linear guide 127 of the floor supporting profile 110 is also co-displaced, whereupon the floor supporting profile 110 likewise begins to fold up. As long as the spring force is activated, the footplate 136 of the floor supporting profile 110 is pressed onto the floor by virtue of the prevailing lever geometry.

Figure 5:
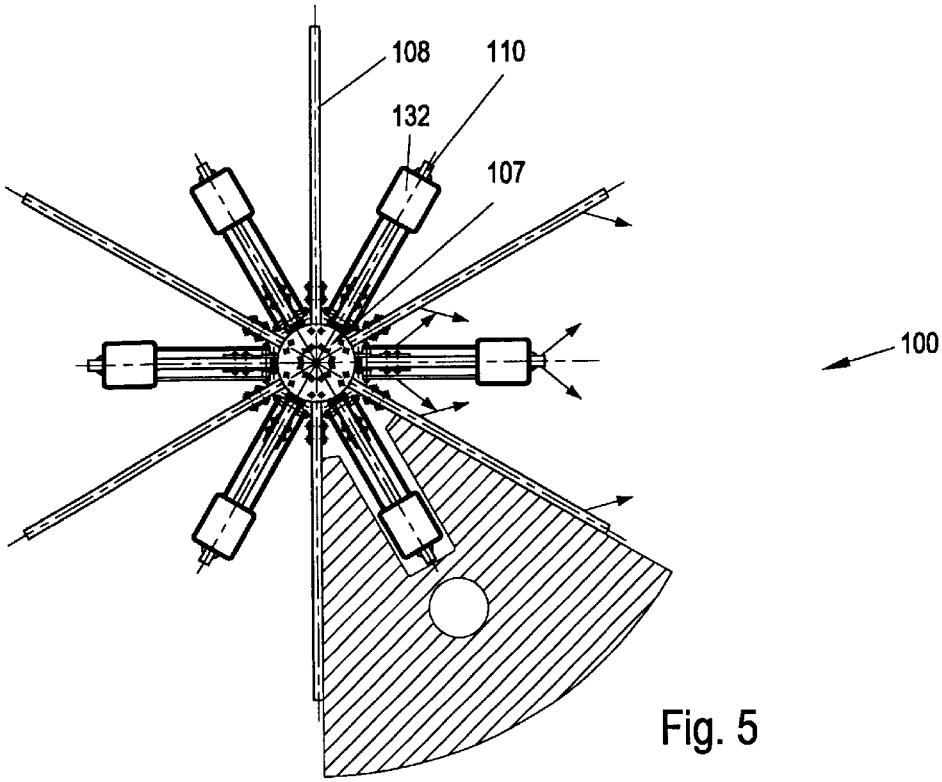
FIG. 5 shows a diagrammatic top view of the training machine according to FIG. 3.
Figure 6:
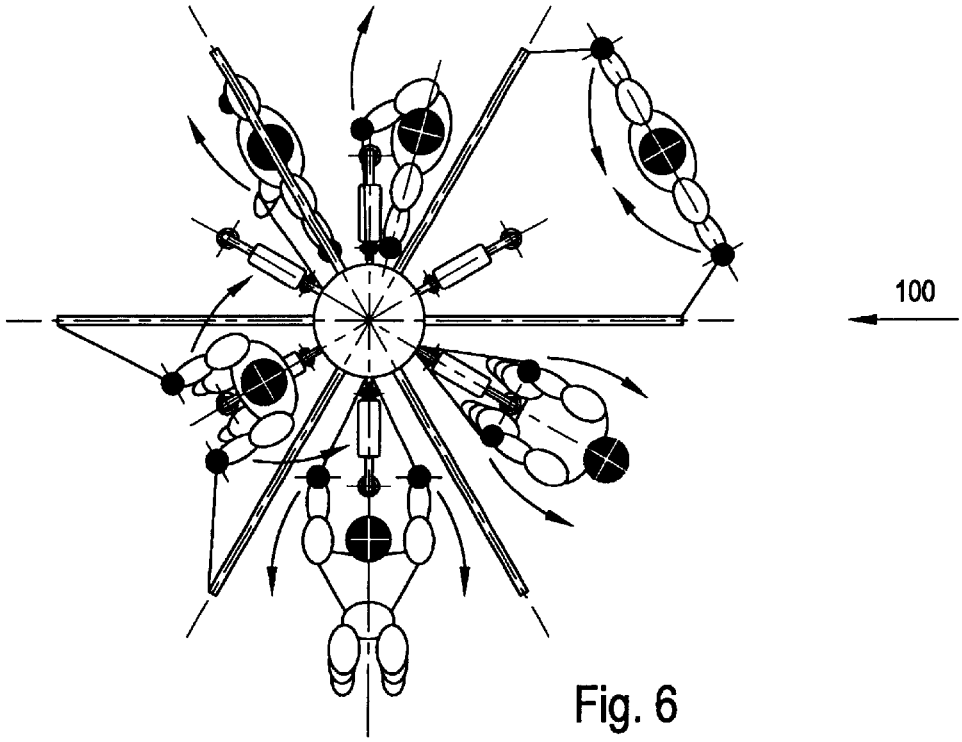
FIG. 6 shows a simplified diagrammatic top view of the training machine according to FIG. 3 which persons exercising individually.
Figure 7:
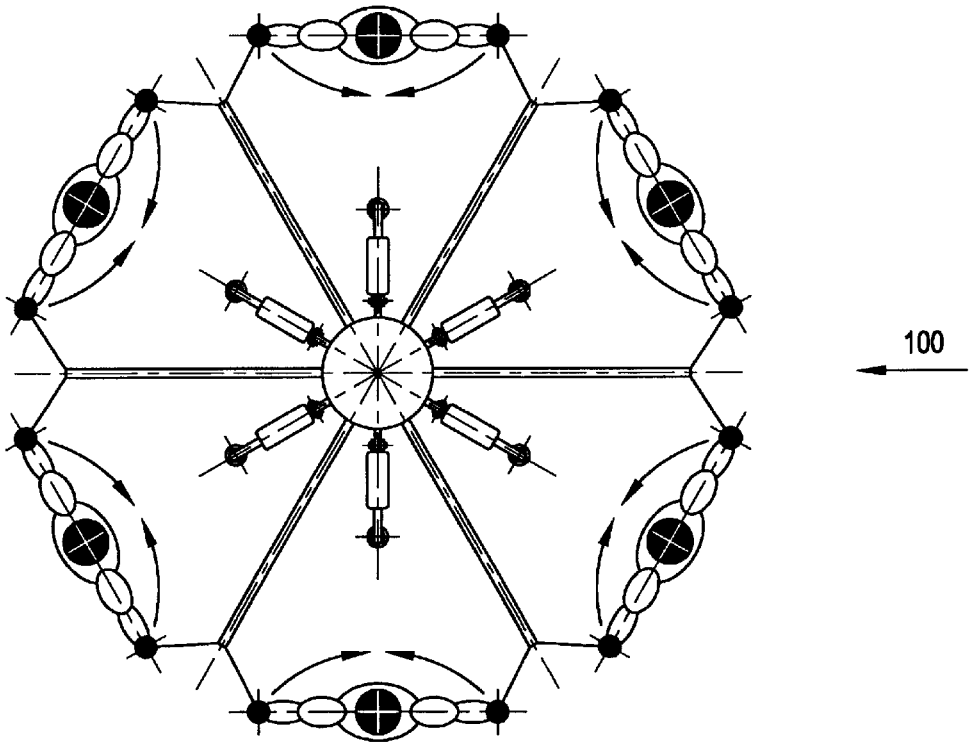
FIG. 7 shows a diagrammatic top view of the training machine according to FIG. 3 with persons exercising group-dynamically.
Figure 8:
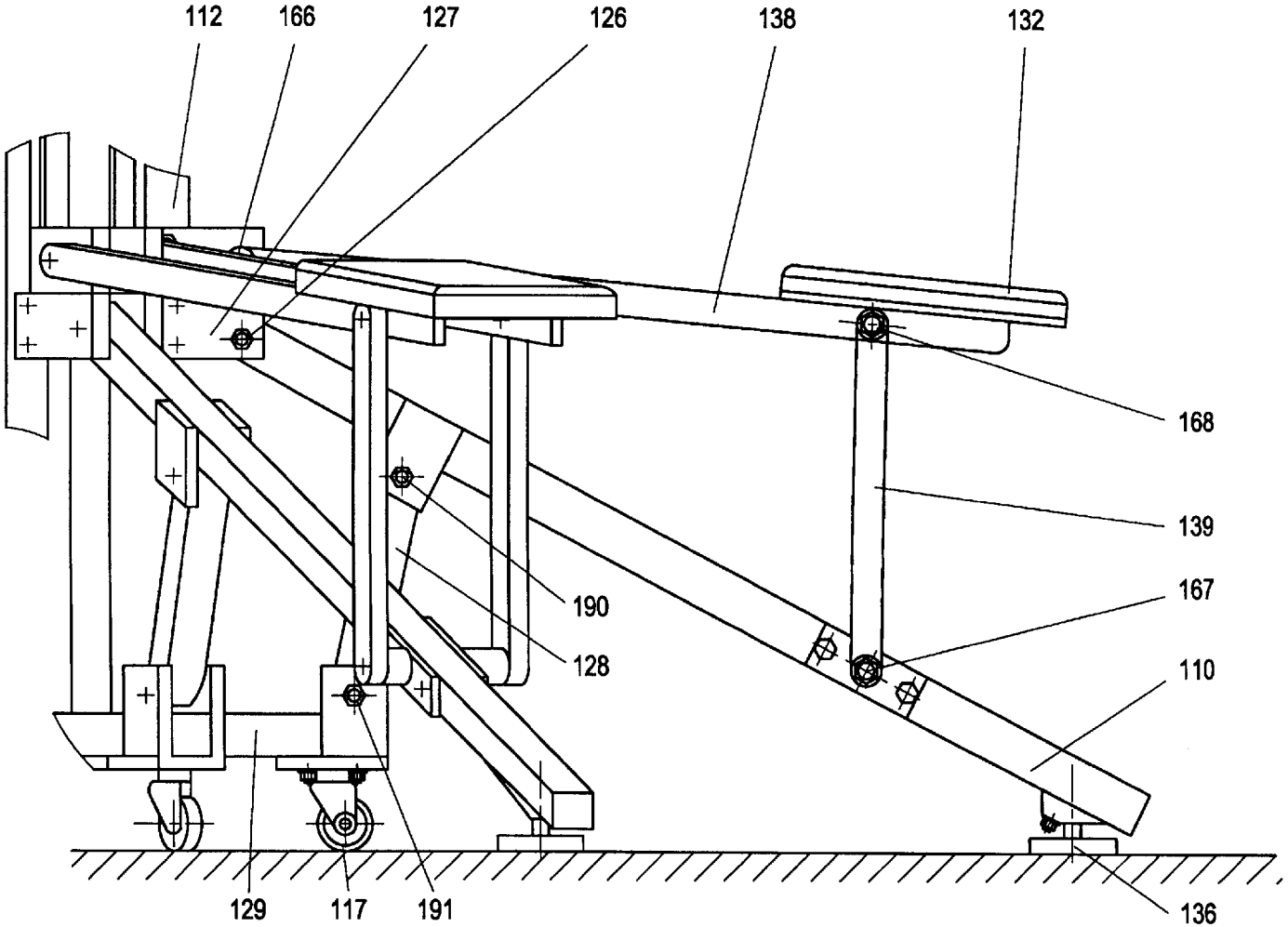
FIG. 8 shows a diagrammatic perspective view of the detail A in FIG. 3.
Figure 9:
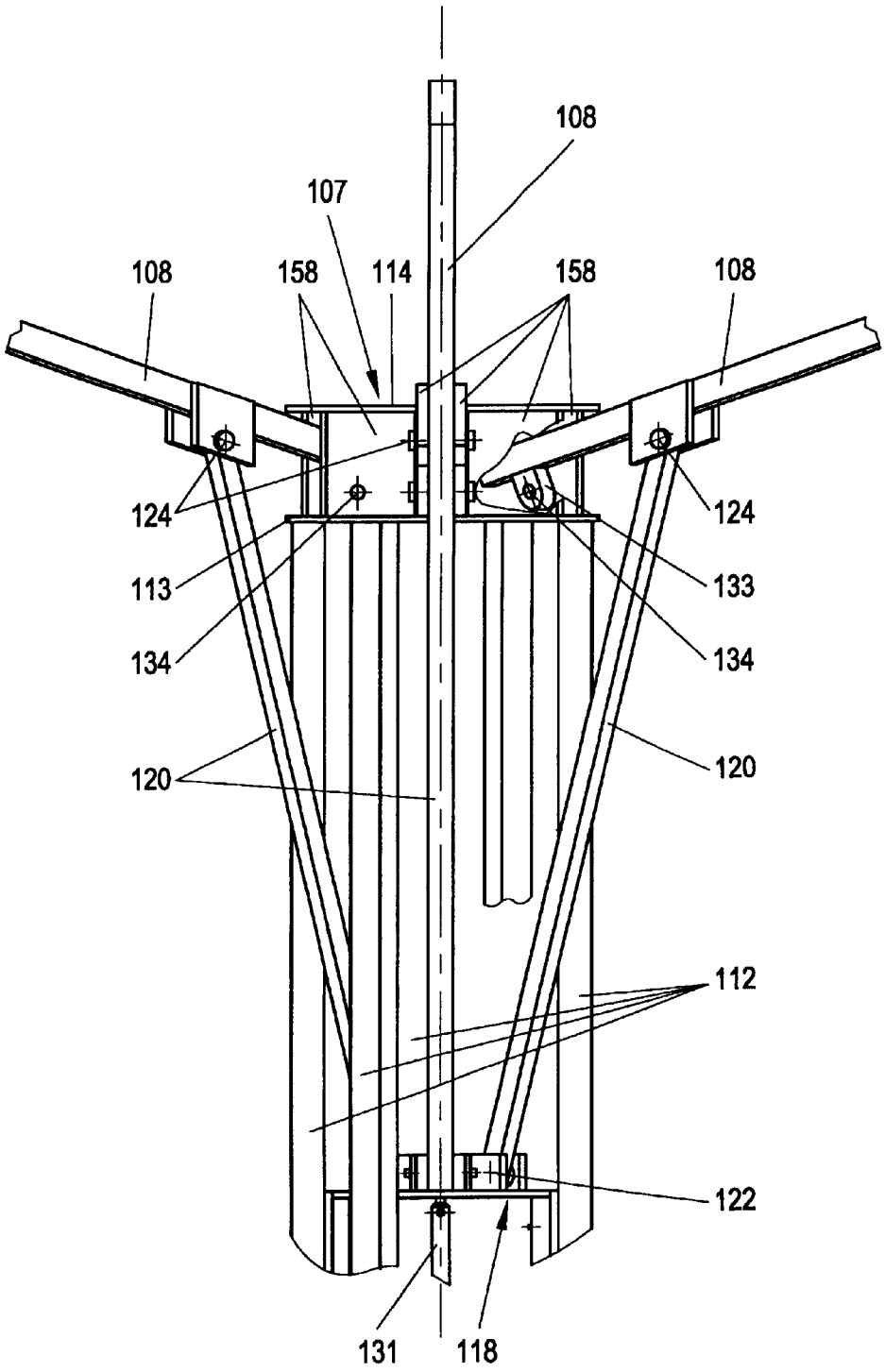
FIG. 9 shows a diagrammatic perspective view of the detail B in FIG. 3.

The folding mechanism was illustrated above, in practice, for a traction-device holding rod 108 and a floor supporting profile 110. According to FIG. 5, there are altogether six traction-device holding rods 108 and six floor supporting profiles 110 which, in the training machine illustrated, can be folded up and unfolded simultaneously or with some time lag.

The training machine illustrated has the possibility of implementing a fold-up multifunctional machine which ensures three-dimensional traction and therefore optimum training facilities.

The use of profile elements with longitudinally continuous mortises for the vertical profile bars 112, the floor supporting profiles 110, the traction-device holding rods 108, the stroke profile bars 120 and the rotary profile bars 118 and the holding profiles 129 makes it possible to provide standardized and reliable connection possibilities, thus allowing economical assembly and at the same time ensuring permanently reliable functioning under load.

The base unit 111 consists of radially arranged holding profiles 129, to the outer end region of which the rollers 117 are fastened on the bottom side in each case and which are connected to one another in the central region via baseplates 116 arranged on the top side and bottom side. The linear drive 130 is connected to the upper baseplate 116. The head unit 107 consists of two head plates arranged at a distance from one another and, in each case, of two guide plates 158 present, parallel to each traction-device holding rod 108, on the left and right sides.

Figure 10:
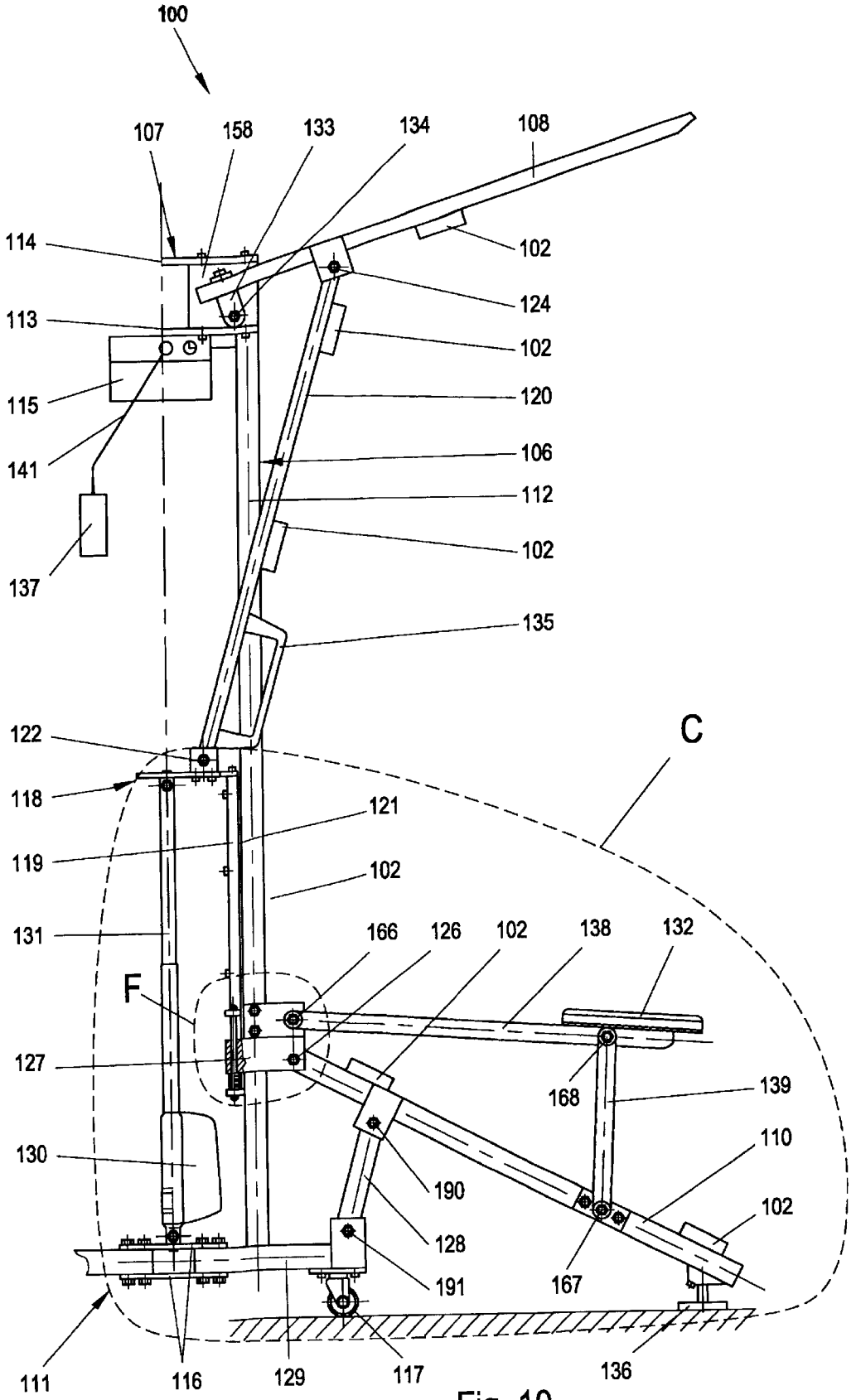
FIG. 10 shows a diagrammatic half-sided view of a detail of the training machine according to FIG. 1, with a traction-device holding rod illustrated and with a floor supporting profile illustrated, having a compression-spring mechanism.
Figure 11:
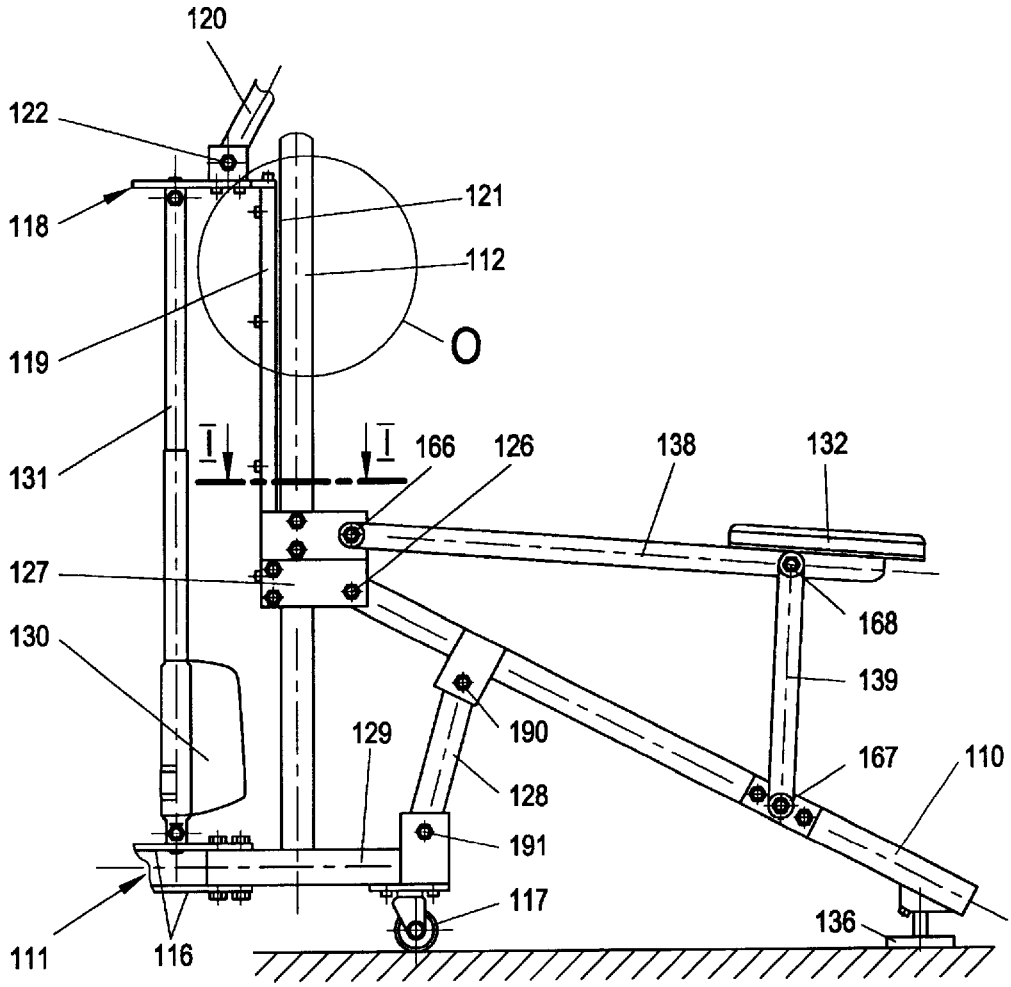
FIG. 11 shows a diagrammatic illustration of the detail C in FIG. 10 without a compression-spring mechanism.
Figure 12:
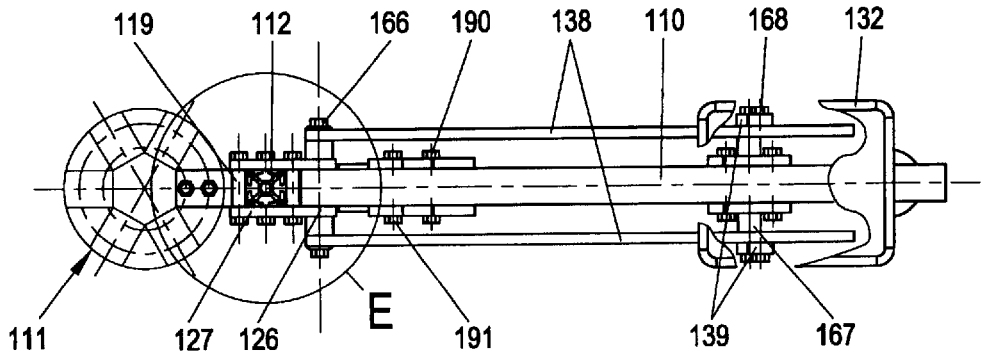
FIG. 12 shows a partially sectional diagrammatic top view of the training machine according to FIG. 11.
Figure 13:
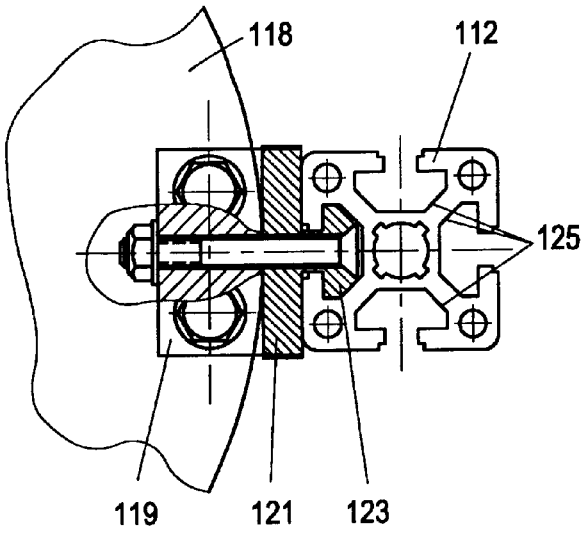
FIG. 13 shows a diagrammatic illustration of the top view of the detail D in FIG. 11.
Figure 14:
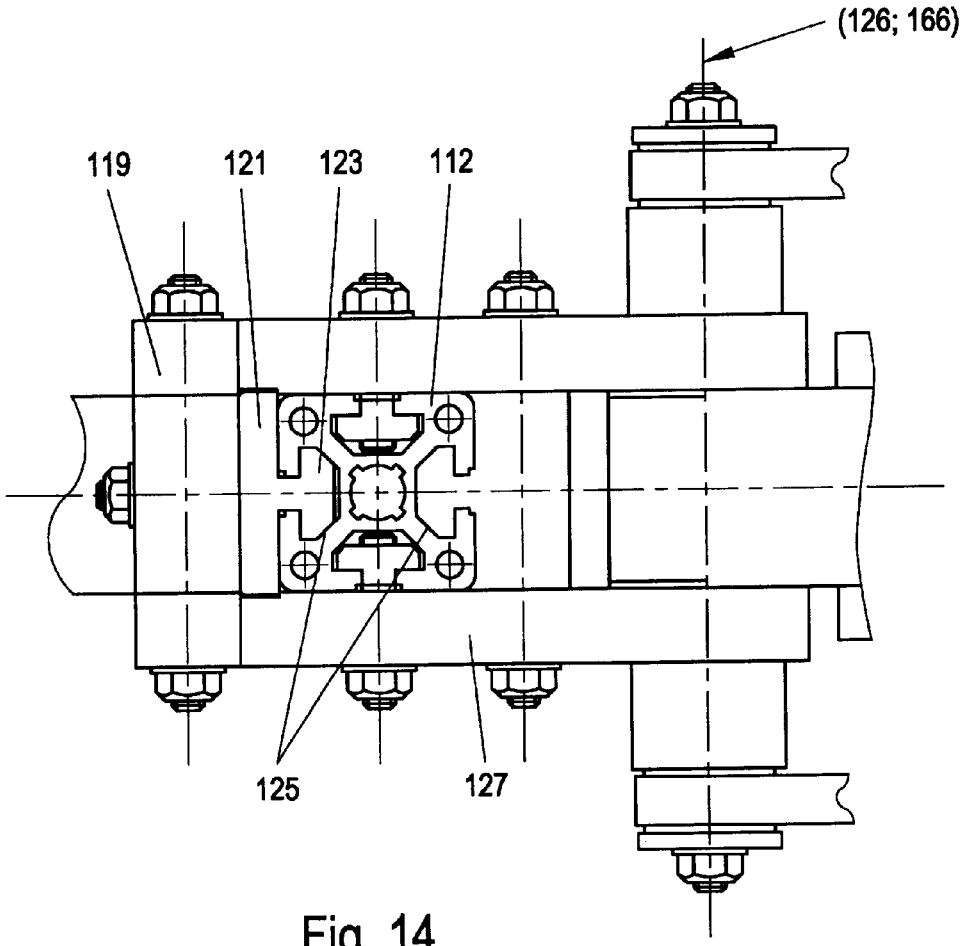
FIG. 14 shows a diagrammatic illustration of the detail E in FIG. 12.
Figure 15:
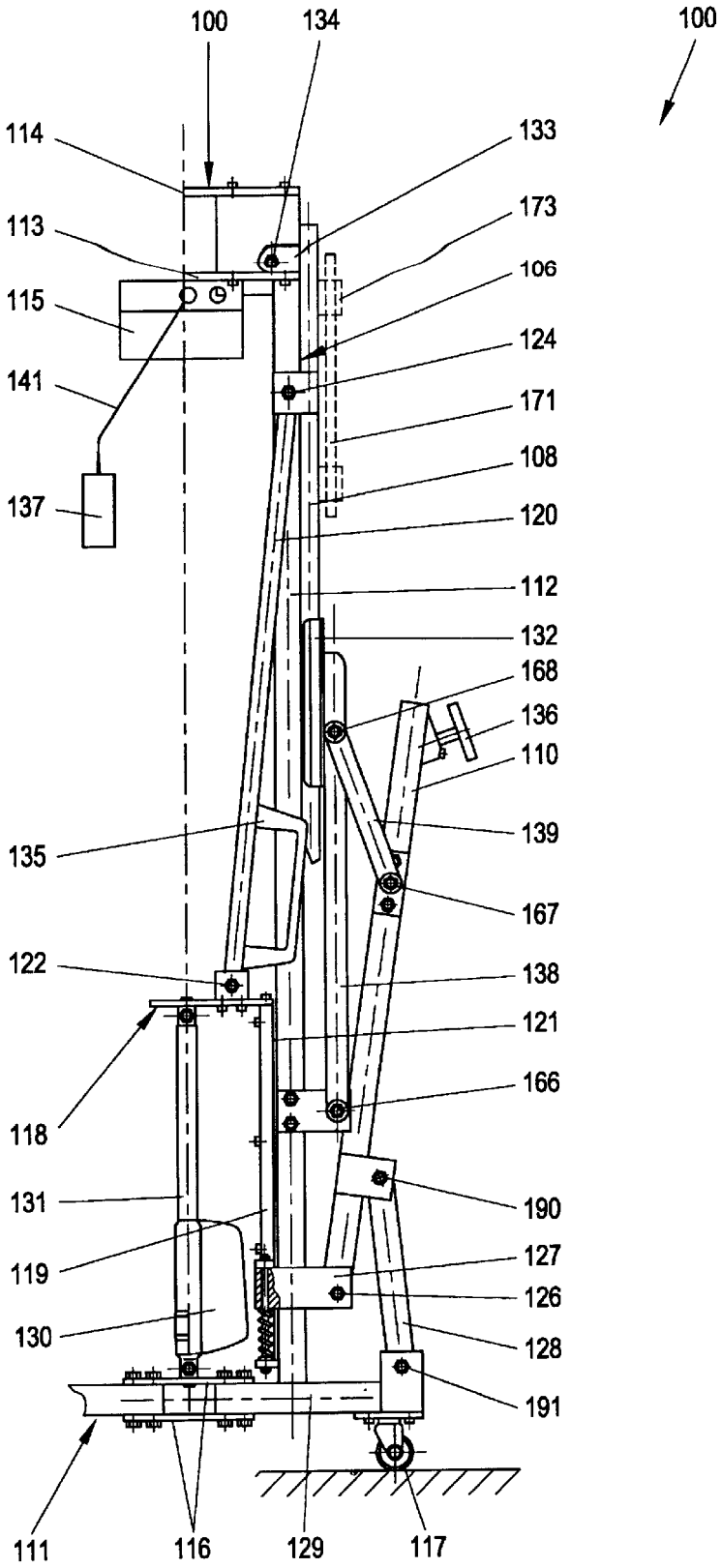
FIG. 15 shows a diagrammatic half-sided side view of a detail of the training machine according to FIG. 10 in the folded-up state.

In FIG. 15, the training machine 110 is illustrated in the folded-up state, as compared with the state illustrated in FIG. 10. FIG. 15 also illustrates, in addition, how, for example, pull grip bars 171 frequently needed can easily be stored on the training machine 100. For this purpose, mountings 173, into which a pull grip bar 171 can be snapped releasably in a simple way, are attached to the traction-device holding rods 108 at the top.

Figure 16:
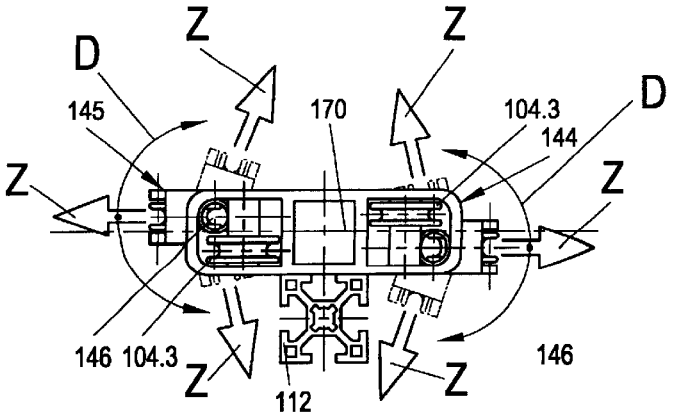
FIG. 16 shows a diagrammatic cross-sectional illustration of an embodiment of a traction device having two deflecting units, each with three deflecting rollers.
Figure 17:
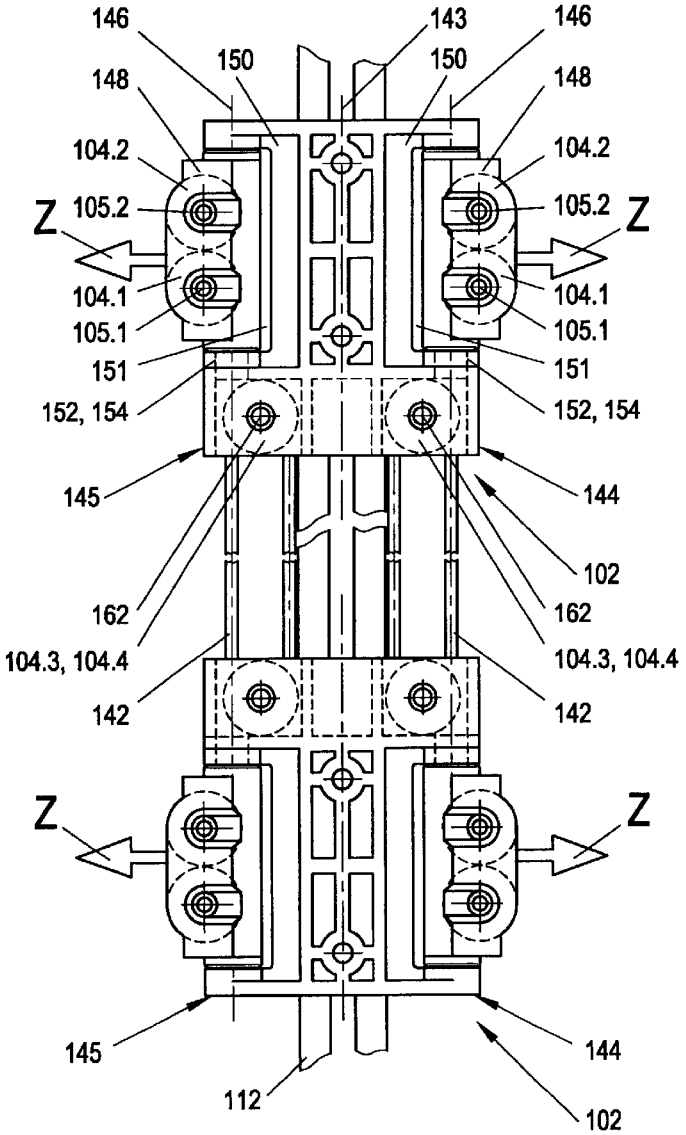
FIG. 17 shows a diagrammatic top view of two traction devices arranged at a distance from one another on a profile bar.
Figure 18:
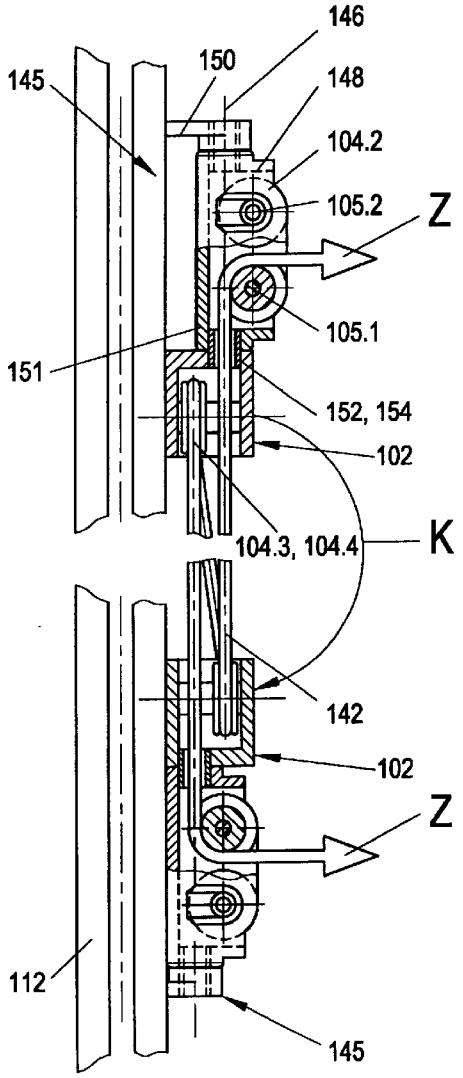
FIG. 18 shows a diagrammatic longitudinal section through the top view according to FIG. 17.
Figure 19:
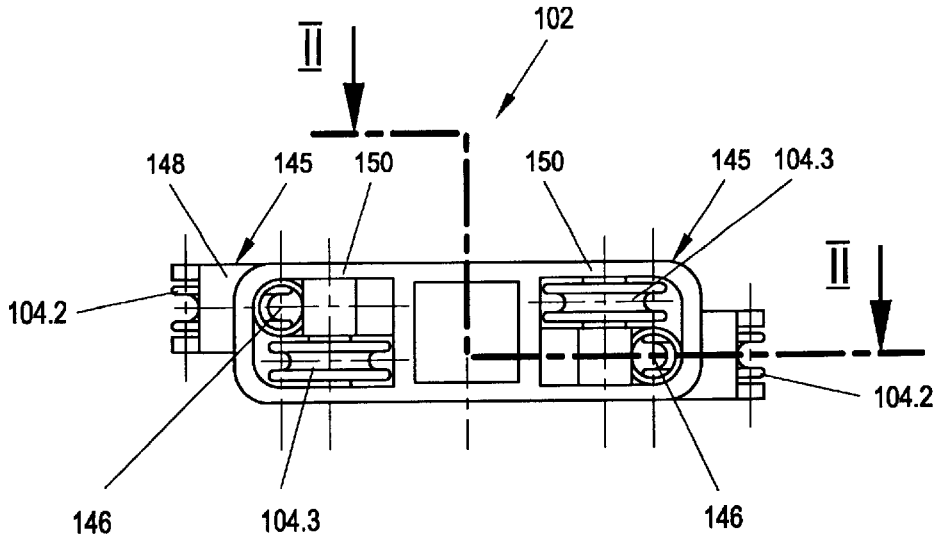
FIG. 19 shows a diagrammatic top view of the traction device according to FIG. 16.
Figure 20:
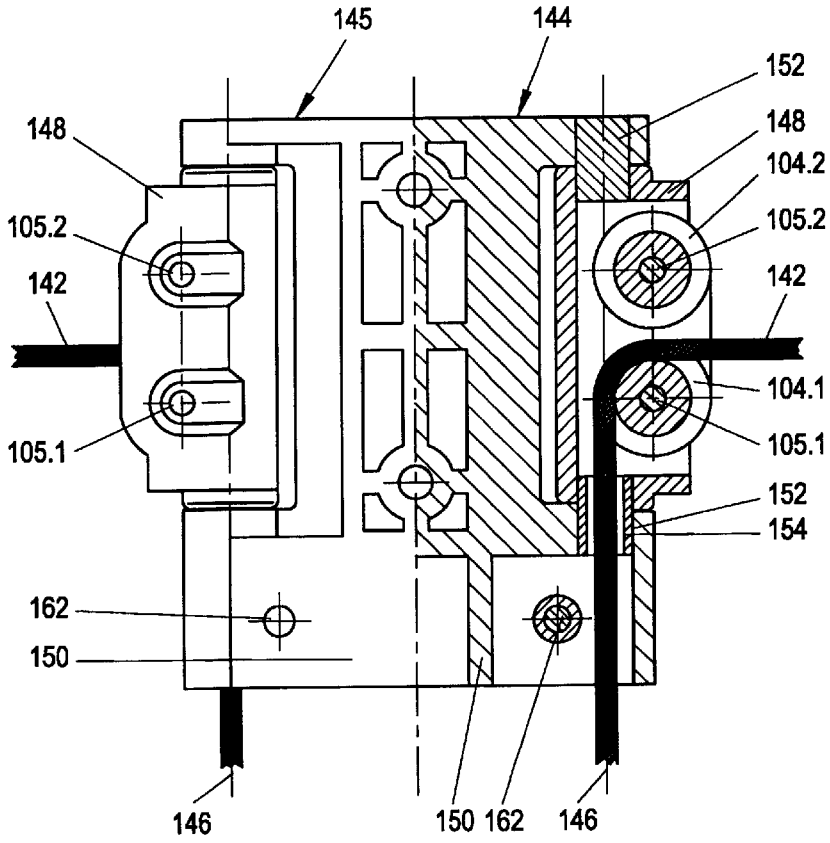
FIG. 20 shows a diagrammatic illustration of the traction device according to FIG. 19 along the sectional line II/II in FIG. 19, FIGS. 21*a, b* show a diagrammatic side view of two traction devices according to FIG. 18, one end of the pull cord being anchored to a hook.

FIGS. 16, 17 and 18 illustrate a traction device 102 which is suitable for being attached to the profile bars 112 of the training unit 100 at the respectively desired location of a profile bar 112.

The traction device 102 possesses a first deflecting unit 144 with a bearing body 150 having a recess 151, within which a roller block 148 is arranged rotatably about an axis of rotation 146 running in the longitudinal direction (see arrow D in FIG. 16). Rotary mounting takes place by means of rotary bearing units 152 which are present on the top side and bottom side and which have a continuous recess 154. Arranged on the roller block 148 are two deflecting rollers 104.1, 104.2 which are arranged one below the other or one above the other and lie in the same rolling plane and between which an elastic pull cord 142 can be pulled out for training purposes. The pull cord 142 is preferably designed as a rubber cord. The axes of rotation 105.1, 105.2 of the deflecting rollers 104.1, 104.2 are offset laterally to the axis of rotation 146 essentially by the dimension of their rolling radius, so that the cord 142 fed through the recess 154 is fed directly in a straight line to the rolling radius of the deflecting rollers 104.1, 104.2. The roller block 148 can thereby be rotated about its axis of rotation 146 (arrow D), without the pull cord 142 being criss-crossed.

Below and above the roller block 148 there is, on the bearing body, a third deflecting roller 104.3 which has its rolling plane offset laterally parallel to the mid-plane 170 of the deflecting unit 144 and the axis of rotation 162 of which is arranged perpendicularly to the mid-plane 170, the distance of the axis of rotation 162 to the axis of rotation 146 corresponding essentially to the rolling radius of the third deflecting roller 104.3. The axis of rotation 146 is likewise offset from the mid-plane 170 of the traction device 102 and specifically opposite to the third deflecting roller 104.3 (see FIG. 16).

As seen in a view of the mid-plane 170, a second deflecting unit 145, having the same structural elements as the first deflecting unit 144, is integrally formed onto the first deflecting unit 144 axially symmetrically to the mid-axis 143 of the traction device 102. As seen in cross section according to FIG. 16, the arrangement of the structural elements of the first deflecting unit 144 is point-symmetrical in comparison with the second deflecting unit 145.

Connection possibilities, not illustrated in any more detail, for connecting the traction device 102 to the profile bar element 112 via tenon blocks, not illustrated in any more detail, are present in the region of the mid-axis 143.

The broad arrows Z will illustrate examples of pulling directions of the pull cord 142.

By virtue of the special axially symmetric and point-symmetric arrangement of the roller elements of the first deflecting unit 144 or of the second deflecting unit 145, the structurally identical traction device 102 can be folded through 180° (see arrow K) and be fastened to the profile bar 112 at a predeterminable distance below the upper traction device, with the result that an intrinsically closed traction system is formed (FIG. 17). The pull cord is fed through the recess 152 in each case via the third deflecting roller 104.3 of the traction device 102 arranged at a distance. The routing of the pull cord is illustrated in FIGS. 17 and 18. Overall, triple deflection of the pull cord occurs between the two traction devices 102 via the deflecting roller 104.3 or 104.4. It is thereby possible to implement relatively long cord lengths, thus affording agreeable traction properties. Furthermore, the necessary pulling force for pulling out the pull cord can be adjusted or varied simply by displacing the traction devices and refastening them to the profile bars. It is also conceivable to colour the pull cords according to the pulling force required.

Figure 21:
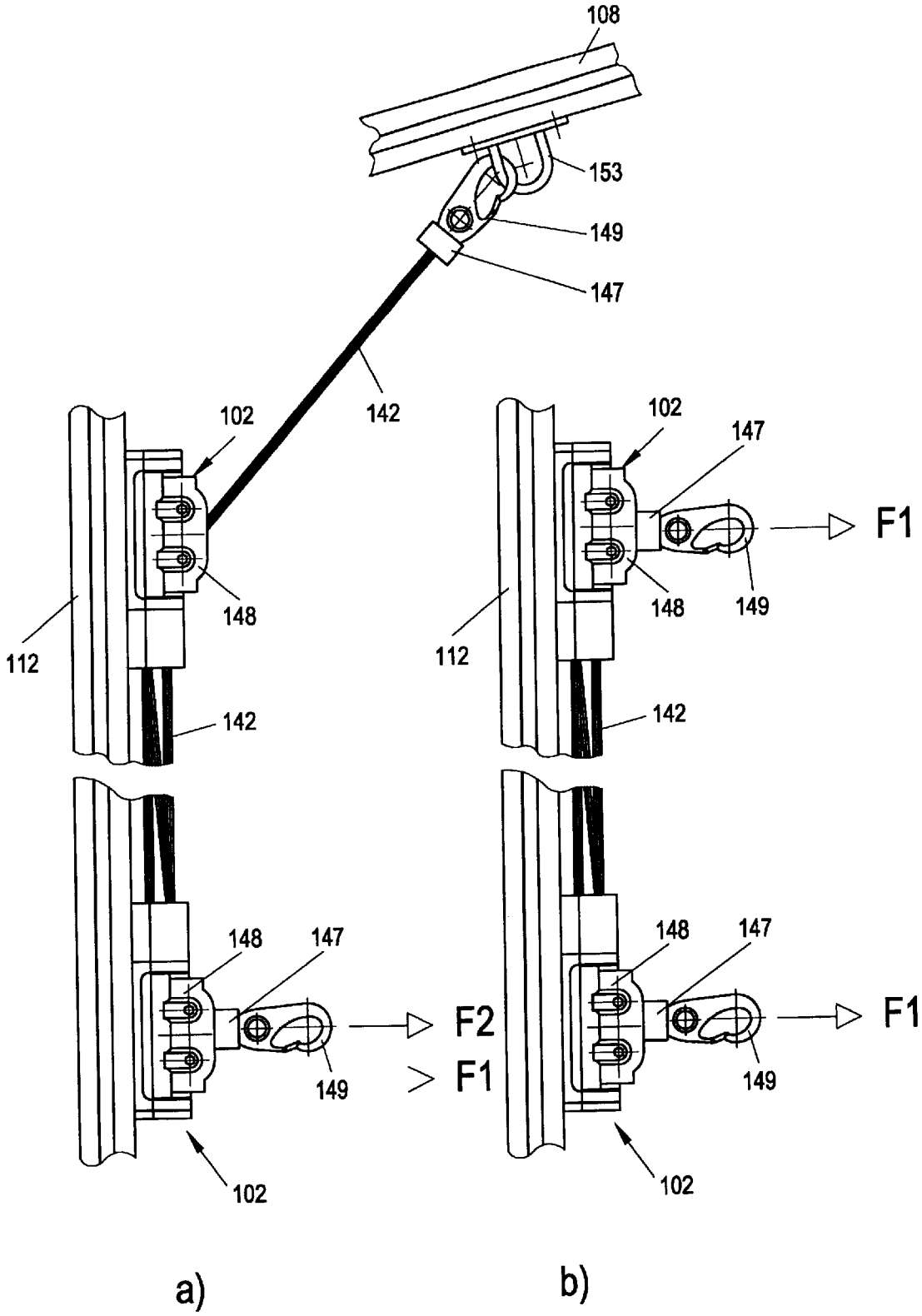
FIG. 21*b* shows a diagrammatic side view of two traction devices according to FIG. 18, FIGS. 22*a* to *f* show a diagrammatic illustration of different structural parts which are arranged on the end of a pull cord and serve for grasping the latter, FIGS. 23*a, b* show diagrammatic views of details of the connection of a guide bar to the longitudinally displaceable rotary joint via compression springs, with the floor supporting profiles in the extended state, according to detail F in FIG. 10, FIGS. 24*a, b* show diagrammatic views of details according to FIG. 23, after the guide bar has executed a particular displacement travel.

FIG. 21*b* shows a side view of two traction devices 102 according to FIG. 18. Arranged in each case in the end region of the pull cord 142 is a rubber buffer 147 which bears against the outer side of the roller block 148 when the pull cord 142 is not being pulled. Moreover, a hook unit 149 is connected, in each case in the end region, to the pull cord 142. The force required to pull out the pull cord F1 is identical for both traction devices 102 according to FIG. 21*b*.

Another possibility for varying the pulling force required to pull out the pull cord 142 is illustrated diagramatically in FIG. 21*a*. In this case, the upper end of the pull cord 142 is pulled out and is anchored by means of an anchoring element 153 at a predeterminable location, for example to the traction-device holding rod 108. This anchoring element 153, too, can be fastened in the profile bars, virtually at any desired location in a simple way by means of tenon blocks.

FIGS. 22*a* to *f* show different design variants of elements for grasping the pull-cord end. As already mentioned, when it emerges from the deflecting-roller unit 144 or 145, the pull cord 142 is guided through a rubber buffer 147 and fastened in a hook 149. Pull straps 153, with rubber pulls 155 located at the respective end, can be snapped into this hook 149, in such a way that, in the case of traction with the hand, both rubber pulls 155 are snapped into the hook and, in the case of traction with the foot, the pull strap 153 is guided through one rubber pull 155 and the other rubber pull 155 is snapped into the hook 149. The latter arrangement as a foot strap ensures that the strap is not pulled shut when it is being actuated. As a result of this material design, the strap 153 is reliably prevented from slipping in the rubber pull 155. During training, the rubber buffer 147 ensures sound insulation when there is a relief of traction and, consequently, when the hook 149 strikes against the roller block 148.

Figure 22:
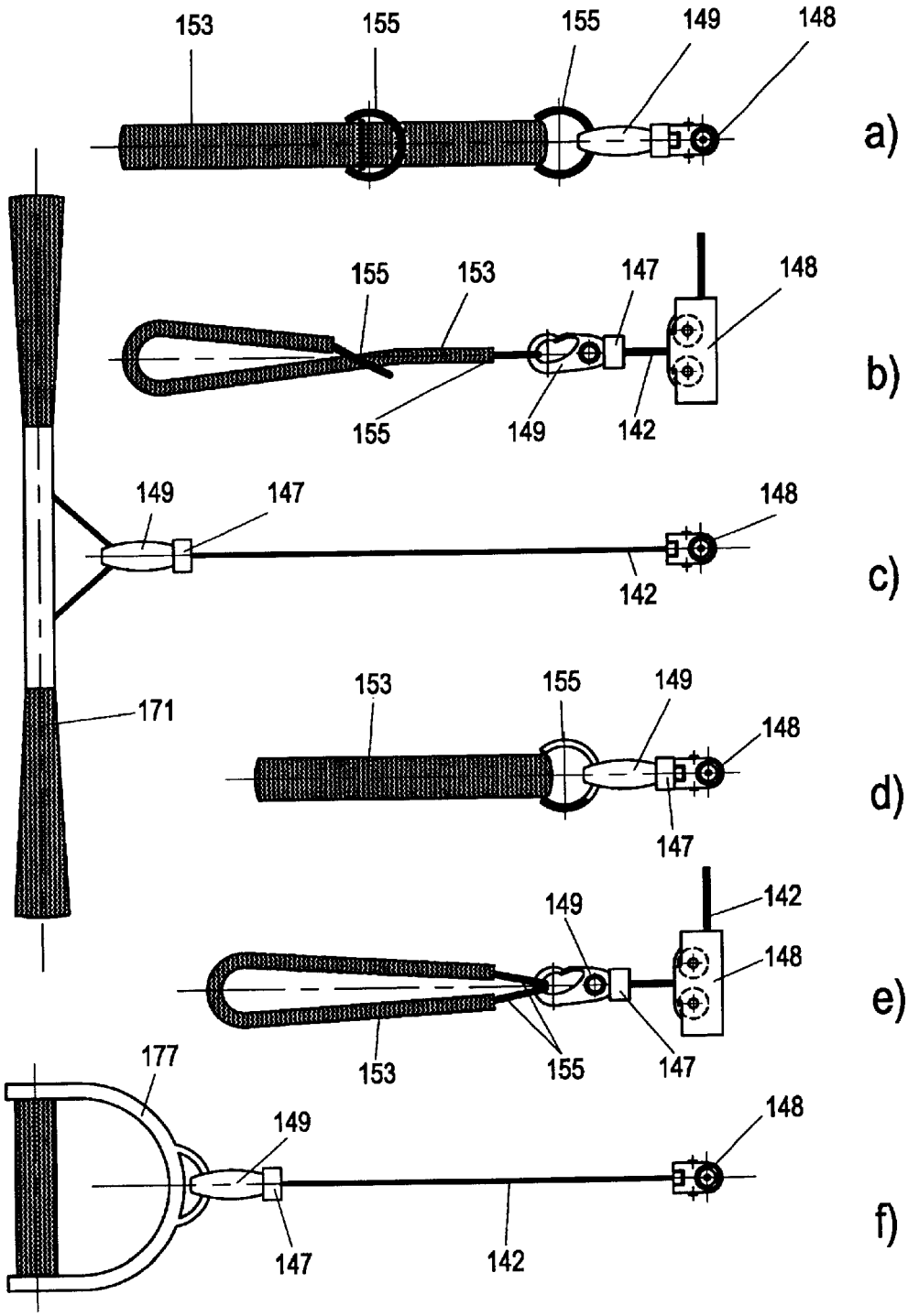

The formation of a strap 153 by a snapping-in of both rubber pulls 155 is illustrated in FIGS. 22*d* and *e*.

FIG. 22*c* shows the use of a pull grip bar 171 and FIG. 22*f* shown the use of a grip 177 as a grasping element for the end of the pull cord 142.

The feed of the pull cord 142 to the traction device 102 does not necessarily have to take place via the third deflecting roller 104.3 of a further traction device 102. This may also take place by the arrangement of a simple roller block with a deflecting roller, in particular in a corner region. It is important for the roller to be arranged in the geometrical arrangement described.

What is claimed is:

1. A training machine (100) for the physical training of persons comprising a plurality of traction devices (102); pull cords (142) and deflecting rollers (104) associated with the traction device (102);

a carrying device (106) constructed as a central unit;

a plurality of traction-device holding rods (108) articulated in the upper region of the carrying device (106); and floor supporting profiles (110) articulated in the lower region on the carrying device (106) wherein the carrying device (106) is movably mounted, wherein the plurality of traction-device holding rods (108) is present circumferentially around the carrying device (106), at least in regions, in a predeterminable pattern, wherein the traction-device holding rods (108) are constructed to be capable of being unfolded and folded up, and wherein the plurality of traction-device holding rods (108), in the unfolded state, delimits the respective training area available to a person for training purposes, wherein the floor supporting profiles (110) are present circumferentially around the carrying device (106) in a predeterminable pattern, wherein the floor supporting profiles (110) are constructed to be capable of being unfolded and folded up, and wherein the floor supporting profiles (110), in the unfolded state, are supported on a standing floor and ensure the stability of the training machine (100), wherein the plurality of traction devices (102) is arranged on the plurality of traction device holding rods (108) and/or the floor supporting profiles (110) and/or the carrying device (106);

wherein the carrying device (106) has essentially vertically arranged profile bars (112) which are connected on the bottom side to a head unit (107), in particular a head plate (114), and on the bottom side to a base unit (112), and wherein between the head unit and base unit (107, 111) there is at least one guide unit (118) which is guided longitudinally movably in or on the profile bars (112), wherein the guide unit (118) is connected directly or indirectly to the plurality of traction-device holding rods (108) and/or the floor supporting profiles (110), and wherein the folding movement of the plurality of traction-device holding rods (108) and of the floor supporting profiles (110) are determined by the motion of the guide unit (118).

2. Training machine according to claim 1, characterized in that the pluarlity of traction-device holding rods (108) and the floor supporting profiles (110) are arranged around the carrying device (106) in a radial pattern.

3. Training machine according to claim 1, characterized in that, as seen in a top view of the training machine (100), the unfolded floor supporting profiles (110) are arranged in each case essentially centrally between two unfolded ones of the plurality of traction-device holding rods (108) in the unfolded state.

4. Training machine according to claim 1, characterized in that a seat (132) is arranged on each of the floor supporting profiles (110).

5. Training machine according to claim 2, characterized in that the circumferential angle between two adjacent ones of the plurality of traction-device holding rods (108) is 180° or 120° or 90° or 60° (old degrees).

6. Training machine according to claim 1, characterized in that there are stroke profile bars (120) which are articulated rotatably on the guide unit (118) via a lower rotary joint (122) and on the plurality of traction-device holding rods (108) via an upper rotary joint (124), and in that the traction-device holding rods (108) are in each case articulated on the head unit (107) via a rotary joint (134).

7. Training machine according to claim 1, characterized in that the floor supporting profiles (110) are articulated on the carrying device (106) profile bar (112) via a longitudinally displaceable rotary joint (126), on which the guide unit (118) acts, and in each case there is a rotary profile bar (128) which is in each case connected in an articulated manner, via rotary joints (190, 191), between the floor supporting profile (110) and the base unit (111) or the carrying device (106).

8. Training machine according to claim 6, characterized in that the plurality of traction devices (102) is arranged on the stroke profile bars (120).

9. Training machine according to claim 1, wherein the operation of folding together the plurality of traction-device holding rods (108) and the floor supporting profiles (110) is designed in such a way that the floor supporting profiles (110) are folded away or folded up with a time lag only after the plurality of traction-device holding rods (108) is already at least partially folded up.

10. A training machine (100) for the physical training of persons comprising a plurality of traction devices (102);

pull cords (142) and deflecting rollers (104) associated with the traction device (102);

a carrying device (106) constructed as a central unit;

a plurality of traction-device holding rods (108) articulated in the upper region of the carrying device (106);

floor supporting profiles (110) articulated in the lower region on the carrying device (106) wherein the carrying device (106) is movably mounted, wherein the plurality of traction-device holding rods (108) is present circumferentially around the carrying device (106), at least in regions, in a predeterminable pattern, wherein the traction-device holding rods (108) are constructed to be capable of being unfolded and folded up, and, wherein the plurality of traction-device holding rods (108), in the unfolded state, delimits the respective training area available to a person for training purposes, wherein the floor supporting profiles (110) are present circumferentially around the carrying device (106) in a predeterminable pattern, wherein the floor supporting profiles (110), are constructed to be capable of being unfolded and folded up, and wherein the floor supporting profiles (110), in the unfolded state, are supported on a standing floor and ensure the stability of the training machine (100), wherein the plurality of traction devices (102) is arranged on the plurality of traction device holding rods (108) and/or the floor supporting profiles (110) and/or the carrying device (106);

a guide unit (118);

an electrically or hydraulically or pneumatically operated drive unit, in particular linear drive unit (130), is present for moving the guide unit (118).

11. Training machine according to claim 10, characterized in that the plurality of traction-device holding rods (108) and the floor supporting profiles (110) are arranged around the carrying device (106) in a radial pattern.

12. Training machine according to claim 10, characterized in that, as seen in a top view of the training machine (100), the unfolded floor supporting profiles (110) are arranged in each case essentially centrally between two unfolded ones of the plurality of traction-device holding rods (108) in the unfolded state.

13. Training machine according to claim 10, characterized in that a seat (132) is arranged on each of the floor supporting profiles (110).

14. Training machine according to claim 11, characterized in that the circumferential angle between two adjacent ones of the plurality of traction-device holding rods (108) is 180° or 120° or 90° or 60° (old degrees).

15. The training machine according to claim 10, wherein the carrying device (106) has essentially vertically arranged profile bars (112) which are connected on the top side to a head unit (107), in particular a head plate (114), and on the bottom side to a base unit (111), and wherein between the head unit and base unit (107, 111) there is at least one guide unit (118)

which is guided longitudinally movably in or on the profile bars (112), wherein the guide unit (118) is connected directly or indirectly to the plurality of traction-device holding rods (108) and/or the floor supporting profiles (110), and wherein the folding movement of the plurality of traction-device holding rods (108) and of the floor supporting profiles (110) are determined by the motion of the guide unit (118).

16. Training machine according to claim 15, characterized in that there are stroke profile bars (120) which are articulated rotatably on the guide unit (118) via a lower rotary joint (122) and on the plurality of traction-device holding rods (108) via an upper rotary joint (124), and in that the traction-device holding rods (108) are in each case articulated on the head unit (107) via a rotary joint (134).

17. Training machine according to claim 16, characterized in that the floor supporting profiles (110) are articulated on the carrying device (106) profile bar (112) via a longitudinally displaceable rotaryjoint (126), on which the guide unit (118) acts, and in each case there is a rotary profile bar (128) which is in each case connected in an articulated manner, via rotary joints (190, 191), between the floor supporting profile (110) and the base unit (111) or the carrying device (106).

18. Training machine according to claim 16, characterized in that the plurality of traction devices (102) is arranged on the stroke profile bars (120).

19. The training machine according to claim 10, wherein the operation of folding together the plurality of traction-device holding rods (108) and the floor supporting profiles (110) is designed in such a way that the floor supporting profiles (110) are folded away or folded up with a time lag only after the plurality of tractione device holding rods (108) is already at least partially folded up.

20. A training machine (100) for the physical training of persons comprising a plurality of traction device (102);

pull cords (142) and deflecting rollers (104) associated with the plurality of traction device (102);

a carrying device (106) constructed as a central unit;

a plurality of traction-device holding rods (108) articulated in the upper region of the carrying device (106); and floor supporting profiles (110) articulated in the lower region on the carrying device (106) wherein the carrying device (106) is movably mounted, wherein the plurality of traction-device holding rods (108) is present circumferentially around the carrying device (106), at least in regions, in a predeterminable pattern, wherein the traction-device holding rods (108) are constructed to be capable of being unfolded and folded up, and, wherein the plurality of traction-device holding rods (108), in the unfolded state, delimits the respective training area available to a person for training purposes, wherein the floor supporting profiles (110) are present circumferentially around the carrying device (106) in a predeterminable pattern, wherein the floor supporting profiles (110) are constructed to be capable of being unfolded and folded up, and, wherein the floor supporting profiles (110), in the unfolded state, are supported on a standing floor and ensure the stability of the training machine (100), wherein the plurality of traction devices (102) is arranged on the plurality of traction device holding rods (108) and/or the floor supporting profiles (110) and/or the carrying device (106);

wherein the carrying device (106) and/or the plurality of traction-device holding rods (108) and/or the floor supporting profiles (110) and/or the stroke profile bars (120) are constructed as metallic profile units which have at least one mortise (125), in particular essentially T-shaped, which is continuous in the profile longitudinal direction, in such a way that structural elements to be connected can be connected via correspondingly shaped tenon blocks.

21. Training machine according to claim 20, characterized in that the plurality of traction-device holding rods (108) and the floor supporting profiles (110) are arranged around the carrying device (106) in a radial pattern.

22. Training machine according to claim 20, characterized in that, as seen in a top view of the training machine (100), the unfolded floor supporting profiles (110) are arranged in each case essentially centrally between two unfolded ones of the plurality of traction-device holding rods (108) in the unfolded state.

23. Training machine according to claim 20, characterized in that a seat (132) is arranged on each of the floor supporting profiles (110).

24. Training machine according to claim 21, characterized in that the circumferential angle between two adjacent ones of the plurality of traction-device holding rods (108) is 180° or 120° or 90° or 60° (old degrees).

25. The training machine according to claim 20, wherein the carrying device (106) has essentially vertically arranged profile bars (112) which are connected on the top side to a head unit (107), in particular a head plate (114), and on the bottom side to a base unit (111), and wherein between the head unit and base unit (107, 111) there is at least one guide unit (118) which is guided longitudinally movably in or on the profile bars (112), wherein the guide unit (118) is connected directly or indirectly to the plurality of traction-device holding rods (108) and/or the floor supporting profiles (110), and wherein the folding movement of the plurality of traction-device holding rods (108) and of the floor supporting profiles (110) are determined by the motion of the guide unit (118).

26. Training machine according to claim 25, characterized in that there are stroke profile bars (120) which are articulated rotatabl on the guide unit (118) via a lower rotary joint (122) and on the plurality of traction-device holding rods (108) via an upper rotary joint (124), and in that the traction-device holding rods (108) are in each case articulated on the head unit (107) via a rotary joint (134).

27. Training machine according to claim 26, characterized in that the floor supporting profiles (110) are articulated on the carrying device (106) profile bar (112) via a longitudinally displaceable rotaryjoint (126), on which the guide unit (118) acts, and in each case there is a rotary profile bar (128) which is in each case connected in an articulated manner, via rotary joints (190, 191), between the floor supporting profile (110) and the base unit (111) or the carrying device (106).

28. Training machine according to claim 26, characterized in that the plurality of traction devices (102) is arranged on the stroke profile bars (120).

29. Training machine according to claim 21 further comprising a guide unit (118);

an electrically or hydraulically or pneumatically operated drive unit, in particular linear drive unit (130), is present for moving the guide unit (118).

30. The training machine according to claim 20, wherein the operation of folding together the plurality of traction-device holding rods (108) and the floor supporting profiles (110) is designed in such a way that the floor supporting profiles (110) are folded away or folded up with a time lag only after the plurality of traction-device holding rods (108) is already at least partially folded up.

31. Training machine according to claim 25 further comprising a guide unit (118);

an electrically or hydraulically or pneumatically operated drive unit, in particular linear drive unit (130), is present for moving the guide unit (118).

* * * * *